US005230217A

United States Patent [19]

Agrawal et al.

[11] Patent Number: 5,230,217

[45] Date of Patent: Jul. 27, 1993

[54] INTER-COLUMN HEAT INTEGRATION FOR MULTI-COLUMN DISTILLATION SYSTEM

[75] Inventors: Rakesh Agrawal, Emmaus; Donald W. Woodward, New Tripoli, both of Pa.

[73] Assignee: Air Products and Chemicals, Inc., Allentown, Pa.

[21] Appl. No.: 885,580

[22] Filed: May 19, 1992

[51] Int. Cl.[5] ..... F25J 3/02

[52] U.S. Cl. ..... 62/22; 62/24

[58] Field of Search ..... 62/11, 24, 22

[56] References Cited

U.S. PATENT DOCUMENTS

| | | | |
|---|---|---|---|
| 4,025,398 | 5/1977 | Haselden | 203/155 |
| 4,234,391 | 11/1980 | Seader | 203/26 |
| 4,605,247 | 8/1986 | Erickson | 62/22 |
| 4,747,859 | 5/1988 | Gladman et al. | 62/24 |
| 4,762,542 | 8/1988 | Mishkovsky et al. | 62/22 |
| 4,883,517 | 11/1989 | Rathbone | 62/22 |
| 5,019,145 | 5/1991 | Rohde et al. | 62/24 |
| 5,076,823 | 12/1991 | Hansel et al. | 62/22 |
| 5,079,923 | 1/1992 | Grenier | 62/22 |
| 5,100,447 | 3/1992 | Krishnamurthy et al. | 62/40 |

OTHER PUBLICATIONS

Lynd, L. R., H. E. Grethlein, "Distillation with Intermediate heat Pumps and Optimal Side Stream Return" AICHE Journal Aug. 1986, vol. 32, No. 8, pp. 1347-1359.

Linnhoff, Bodo, Helen Dunford, Robin Smith, "Heat integration of Distillation Columns Into Overall Processes" Chemical Engineering Science vol. 36, No. 8 pp. 1175-1188 1983.

Fidkowski, Zbigniew; Lechosian Krolikowski "Minimum Energy Requirements of Thermally Coupled Distillation Systems" AIChe Journal, Apr. 1987, vol. 33, No. 4, pp. 643-653.

*Primary Examiner*—Ronald C. Capossela

*Attorney, Agent, or Firm*—Russell L. Brewer; James C. Simmons; William F. Marsh

[57] ABSTRACT

This invention relates to an improvement in a process for the separation of a multi-component stream comprising component A, B and C with A being the most volatile and C the least volatile. A multi-component feed is introduced to a multicolumn distillation system comprising a first or main distillation column and a side column wherein at least a light component A is separated from a heavier component C in the main distillation column, the lighter component A being removed as an overhead fraction and the heavier component C being removed as a bottoms fraction. The improvement for enhanced recovery of component B in the side column comprises withdrawing a liquid fraction from the main distillation column at a point intermediate the overhead and feed and introducing that liquid fraction to an upper portion of the side column. Lighter components are withdrawn as an overhead from the side column and returned to an optimal location in the distillation system, typically the main distillation column. A vapor fraction is also withdrawn from the main distillation column at a point intermediate the bottoms and feed and vapor fraction is introduced to a lower portion of the side column. A liquid fraction is withdrawn as bottoms and returned to the main distillation column. Thermal integration in the side column is effected by removing a portion of the liquid typically from the stripping section of the side column and vaporizing this fraction against a vapor fraction obtained from the main distillation column.

18 Claims, 4 Drawing Sheets

INTER-COLUMN HEAT INTEGRATION FOR MULTI-COLUMN DISTILLATION SYSTEM

BACKGROUND OF THE INVENTION

1. Technical Field

This invention relates to an improvement in a process for the distillation, separation and recovery of select components in a multi-component stream and to the further improvement with heat integration by thermally coupling columns in a multi-column distillation system.

2. Description of the Prior Art

Fractional distillation of multi-component streams to effect separation is a well known chemical engineering process and is used extensively in the chemical industry. It is well recognized that although distillation is widely used, it is also energy-intensive and often is the dominant cost in a distillation process. With rising energy costs efforts have been made to enhance the efficiency of the distillation process through thermal coupling or through the use of heat pumps and the like. Representative art illustrating the enhancement of distillation efficiency via heat pumps or thermal coupling include the following:

An article entitled "Minimum Energy Requirements of Thermally Coupled Distillation Systems", AICHE Journal, Vol. 33, No. 4, (pp. 643–653, April 1987) discloses four different thermally coupled distillation systems consisting of distillation columns connected by liquid and vapor countercurrent streams. One embodiment shows thermal coupling to a main column with a side arm column wherein a vapor is removed from the rectification zone in the main column and fed to an upper portion of the side column. A liquid stream from the side column then is returned as reflux to the rectification zone in the main column. A liquid is removed from the stripping section of the main column and fed to a lower portion of the side column. The vapor is returned to the stripping zone of the main column. (Page 644) Another embodiment shows a thermally coupled system associated with a stripping column wherein liquid is removed from the main column and introduced to an upper portion of the stripping column. Lighter components are removed therefrom with the vapor from the stripping column being returned to the main column. Reboilers are associated with both the main column and stripping column to provide boilup. (Page 647)

An article entitled "Heat Integration of Distillation Columns Into Overall Processes", Chem. Engineering Science, Vol. 38, No. 8, pages 1175–1188 (1983), discloses energy enhancing techniques for the separation of multi-component systems in a multi-column distillation process. It was noted in a conventional method reactor feeds were preheated with other process streams and steam. Steam was used as a heat source for the reboilers. By passing the feed through the vaporizer side of a reboiler for the main distillation column for effecting vaporization of the liquid at the bottom of the column one reduces the need for steam.

An article entitled "Distillation with Intermediate Heat Pumps and Optimal Side Stream Return", AICHE Journal, Vol. 32, No. 8, pages 1347–1359, (August 1986), discloses the separation of multi-component streams using a multi-column distillation system. The term "heat pump" as conventionally used in these systems referred to the removal of heat from a location in the rectification section in the distillation column to the stripping section of the distillation column. One of the simpler techniques used in the prior art involved the movement of heat from the overhead vapor in a distillation system to the reboiler in an adiabatic column to effect an alteration of the internal reflux ratio. Examples of various methods of altering the internal reflux ratio involved removing vapor from a column at a point above a feed plate, condensing that vapor fraction in a reboiler and returning it to an optimal location. Another process scheme involved removal of liquid from the stripping section of a column, vaporization at the expense of compressed overhead vapor, and return to an optimal point in the column.

U.S. Pat. No. 4,025,398 discloses a fractional distillation process wherein multiple columns are intercoupled to provide variable reboil and variable reflux so as to approach thermodynamically ideal fractionation. The system comprised a variable reboiler column and a variable reflux column wherein the variable reflux column was operated at a higher pressure and mounted at a lower level than the variable reboil column. Vapor was drawn from the variable reflux column, condensed at an upper level in the variable reboil stripping column and returned to the variable reflux column.

U.S. Pat. No. 4,234,391 discloses a continuous distillation apparatus incorporating separate stripping and rectifying sections in tandem, each of which are segregated into a plurality of vapor/liquid contact stages. In this process, the rectifying section of the column is operated at a higher pressure than the stripping section and this is achieved by compressing vapor from the stripping section prior to introducing the vapor into the rectifying section.

U.S. Pat. No. 4,605,247 discloses a process for the production of medium to high purity oxygen as well as other components contained in air. A triple pressure distillation process is developed in which the low pressure column has an argon stripping section and a rectification section reboiled by the high pressure column. At least one latent heat exchange is made from an intermediate height of the low pressure column with an intermediate height in a moderate pressure column. Latent heat exchanges are used to insure high reboil through the argon stripping section of the low pressure column.

SUMMARY OF THE INVENTION

This invention relates to an improvement in a process for the separation of a multi-component feed by distillation. A multi-component feed containing components A, B & C is introduced to a multi-column distillation system comprising a main distillation column and a side column wherein at least a light component A is separated from a heavier component C in the main distillation column, the lighter component A generally being removed as an overhead fraction and the heavier component C generally being removed as a bottoms fraction. Component B which has a volatility intermediate of that volatility of components A & C, typically is recovered in the side column.

The improvement for obtaining enhanced recovery of a preselected component(s), e.g., component B, in a stream containing at least components A, B & C in a multi-column distillation system comprising a main distillation column and a side column comprises the steps:

(a) withdrawing a liquid fraction rich in component B contaminated with component A which has a higher volatility than component B and containing a lower concentration of component C which has a lower volatility than component B from said main distillation column and introducing said liquid fraction to a stripping section within said side column;

(b) withdrawing a vapor fraction rich in component B contaminated with component C which has a lower volatility than component B and containing a lower concentration of component A which has a higher volatility than component B from said main distillation column and introducing said vapor fraction to a rectification section within said side column;

(c) removing component B at preselected concentration from said side column at a point intermediate the introduction point of said liquid fraction rich in component B and containing a much lower concentration of component C and the introduction point of said vapor fraction rich in component B and containing a much lower concentration of component A;

(d) removing a vapor fraction rich in component A from a stripping section within said side column and returning said vapor fraction to said main distillation column;

(e) removing a liquid fraction rich in component C from a rectification section within said side column and returning said liquid fraction to said main distillation column; and (f) thermally integrating said side column with said main distillation column by at least one of the following steps designated (i) and (ii):

(i) vaporizing at least a portion of a liquid fraction obtained from said side column against a vapor fraction obtained from said main distillation column and thereby effecting at least partial condensation of said vapor fraction obtained from the main distillation column and at least partial vaporization of said liquid fraction obtained from said column;

returning at least a portion of the condensed vapor fraction obtained from the main distillation column to the multi-column distillation system; and, returning at least a portion of the vaporized liquid fraction from the side column to the multi-column distillation system; and (ii) condensing at least a portion of a vapor fraction obtained from said side column against a liquid fraction obtained from said main distillation column and thereby vaporizing at least a portion of said liquid fraction obtained from the main distillation column and condensing at least a portion of the vapor obtained from the side column, returning at least a portion of the vaporized liquid fraction obtained from the main distillation column to the multi-column distillation system; and, returning at least a portion of the condensed liquid fraction obtained from the side column to the multi-column distillation system.

Typically, one aspect of thermal integration is achieved by withdrawing a liquid fraction from an upper portion or the stripping section of the side column and vaporizing it against a vapor stream withdrawn from said main distillation column. Generally, at least some of the vaporized liquid fraction is returned to said side column for providing required vapor flow to said side column and at least a portion of the condensed vapor fraction from the main distillation column is returned to the main distillation column system. Typically, this return is above the vapor removal point from said main distillation column for enhancing liquid flow in this regime of the main distillation column. Another aspect of thermal integration calls for at least a portion of the vapor fraction from the lower portion or rectification section of said side column being condensed and at least a portion of the condensed fraction returned to the multi-column distillation system as liquid typically to a point above the vapor removal point from said side column. On the other hand, at least a portion of the liquid fraction withdrawn from the main distillation column and vaporized against a vapor fraction from the side column is returned to the multi-column distillation system, typically to the main distillation column for providing enhanced vapor flow to said main distillation column.

There are significant advantages associated with the unique integration and thermal coupling of columns in a multi-column distillation system as described herein. These include:

effective and efficient heat integration of columns in a multi-column distillation system for the separation of multi-component feeds;

enhanced recovery of preselected components in a side column utilizing a thermally coupled side column with a main distillation column;

enhanced efficiency in the separation of components in the main distillation column; and an ability to achieve thermal coupling and heat integration in a distillation system without substantial capital investment.

THE DRAWINGS

DETAILED DESCRIPTION OF THE INVENTION

Distillation of multi-component streams or feeds containing more than two components, e.g., components A, B and C wherein components A and C are the light and heavy components respectively and B is a component having a volatility intermediate that of A and C can be effectively conducted by the process described herein. Examples of multi-component streams suited for distillation include hydrocarbon streams such as those containing methane, ethane, propane and heavier components or an air stream wherein the major components include nitrogen as component A, oxygen as component C and argon as component B.

Figure 1:
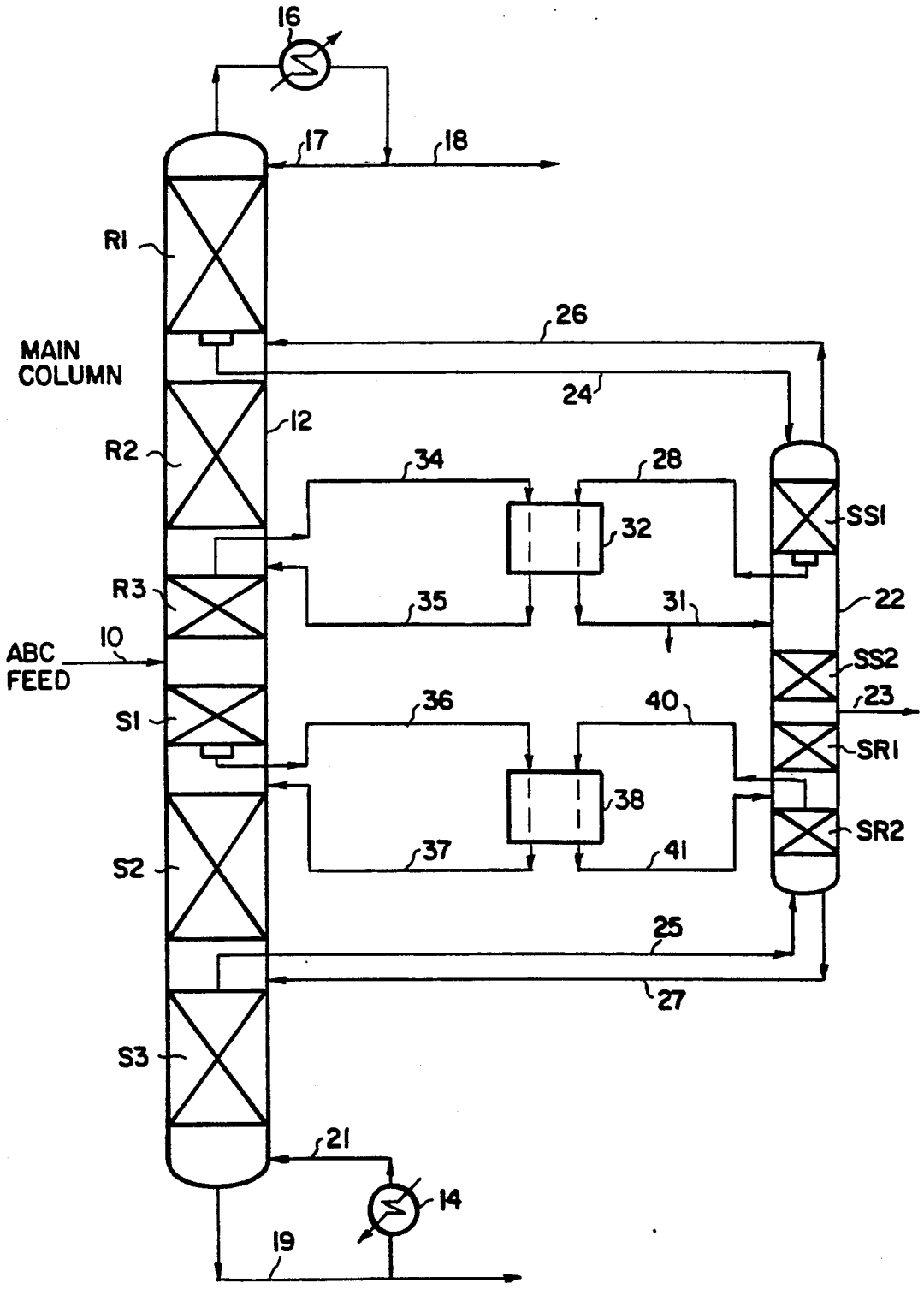
FIG. 1 is a process flow scheme for a multi-column distillation system employing thermal coupling of a side column with a main distillation column in both rectifying and stripping sections of the side column.

To facilitate an understanding of the invention reference is made to FIG. 1. This process flow diagram involves the distillation of a ternary gas mixture comprising components A, B and C wherein components A and C are the light and heavy components respectively and component B has a volatility intermediate to the higher volatility of component A and to the lower volatility of component C. It follows that additional components to that of component A having higher volatility than component B and additional components to that of component C having lower volatility than component B may be present, e.g., a stream containing components A, B, C, D & E, but the principles disclosed for the preselected recovery of components of intermediate volatility will apply to those streams as well as the simpler ternary stream described herein. For example, when there are more than three components, the components lighter than the intermediate component to be recovered can be lumped together and treated as component A; and, similarly, components heavier than the intermediate component can be lumped together and treated as component C.

In this process a multi-component feed comprising components A, B, and C is introduced via line 10 to main distillation column 12 having rectification zones R1, R2, and R3 and stripping zones S1, S2 and S3. Main distillation column 12 is equipped with reboiler 14 for effecting boilup of liquid and providing a source of vapor at the bottom of the column and a condenser 16 for condensing overhead vapor from the top of the column and providing a source of reflux at an upper position of the column. Line 17 is used to return condensate from condenser 16 to the rectification zones and providing reflux thereto. Line 18 is used for removal of component A as product. Component C is removed from main distillation column 12 as a bottoms fraction via line 19 and a vaporized portion is returned to main distillation column 12 via line 21.

Component B is separated from components A and C in side column 22 and removed via line 23. In this embodiment side column contains two stripping sections SS1 and SS2 and two rectification sections SR1 and SR2. Two sources of a feed enriched in component B are provided to side column 22. One source of feed is obtained as liquid enriched in component B and having a concentration less than that desired of the heavier or lower volatility components, e.g., component C. In many cases this level of component C is small. This liquid stream is withdrawn from main distillation column 12 via line 24 and introduced to a stripping section within side column 22. Liquid descends the stripping section(s); e.g., SS1 and SS2 in side column 22 and is contacted with upwardly rising vapor. Another source of feed is obtained by withdrawing a vapor fraction substantially free of the lighter and higher volatile components A (it is enriched in component B and has a concentration of A less than that desired in product B), of the higher volatile component A from a lower portion of main distillation column 12 via line 25 and introducing that vapor fraction into a lower portion or rectification sections SR1 and SR2 of side column 22 for providing vapor flow upwardly through the column. Typically the concentration of component A in the vapor stream will be relatively small.

A liquid fraction rich in component C is removed from a lower portion of side column 22 via line 27 and returned to main distillation column 12. Typically, the point of return is proximate the point of removal of the vapor removed from the main distillation column, although other locations are permitted in the distillation process. Vapor is removed from a stripping section of side column 22 via line 26 and returned to a optimal point to main distillation column 12 or to another section as desired in the multi-column distillation system. Typically, this return will be at a point substantially near the liquid removal point in main distillation column 12 as feed to side column 22. In this case vapor is returned to the rectification zone R1 in main distillation column 12.

Thermal integration of side column 22 with the main distillation column 12 can be achieved by one or both of the following methods. One efficient manner (the first method) of thermal integration of side column 22 with main distillation column 12 is achieved by removal of a vapor stream via line 34 at a point above feed line 10 and heat exchanging that vapor stream against a liquid fraction obtained from a stripping section in side column 22 via line 28. On heat exchange the liquid stream from the side column is at least partially vaporized and the vapor stream from the main distillation column is at least partially condensed in boiler/ condenser 32 against a liquid stream from side column 22. The vapor stream is generally taken from any point within main distillation column 12 as can the liquid stream from the side column. The condensed vapor is returned via line 35 generally to an optimal point in main distillation column 12 while the vaporized liquid is returned via line 31 to side column 22. Typically the point of return for both condensed vapor and vaporized liquid to main distillation column 12 and side column 22 respectively is the point where the vapor and liquid are removed. Several variations of this method are possible. If the amount of vapor withdrawn in line 34 is much larger than the amount required for condensation such that the vapor stream is only partially condensed in heat exchanger 32, then the resulting partially condensed stream 35 is preferably fed to the same location of the main distillation column 12 from where stream 34 is withdrawn. On the other hand, if the amount of vapor withdrawn in line 34 is such that it is either substantially or totally condensed in heat exchanger 32, then the resulting condensed stream in line 35 can be fed to a separation stage above the separation stage from where stream 34 is withdrawn. Similarly, if the liquid stream in line 28 is partially vaporized in heat exchanger 32, then it is preferably fed to the same location as withdrawal of liquid in line 28. On the other hand, if the liquid in line 28 is either totally or near totally vaporized in heat exchanger 32, then it can be preferably fed to a point a couple of separation stages below the separation stage from where liquid stream 28 is withdrawn from side column 22.

In a second method for thermal integration of the main distillation column with the side column, a liquid fraction is obtained from main distillation column 12 via line 36 and routed to boiler/condenser 38 wherein said liquid stream is at least partially vaporized against a vapor stream taken from a rectification section in side column 22. The vaporized liquid stream from the main distillation column is returned to a suitable location of the main distillation column 12. The vapor stream from side column 22 is at least partially condensed in boiler/-condenser 38 and the condensed stream is returned via line 41 to a suitable point within side column 22.

Similar to the first method, several variations of this second method are possible. If the liquid stream withdrawn from the main column in line 36 is partially vaporized, then the partially vaporized stream from heat exchanger 38 is preferentially returned to the same stage of separation as the one for withdrawal of stream 36 from the main distillation column 12. On the other hand, if stream line 36 is either substantially or totally or nearly totally vaporized, the it can be preferentially returned to a stage which is a couple of stages below the withdrawal stage of stream 36. Similarly, if vapor stream in line 40 from the side column 22 is partially condensed, then it is preferentially returned via line 41 to the same location as the withdrawal point of stream 40. On the other hand, if vapor stream 40 is either substantially or totally condensed in heat exchanger 38, then the condensed stream can be preferentially returned to a separation stage which is somewhat higher than the separation stage from where stream 40 is withdrawn.

The thermal integration can be achieved by employing either the first or second method or both in combination for achieving desired results in the performance of main distillation column 12 and the performance of side column 22 in the recovery of component B.

The selection of an appropriate vapor stream elgible for condensation and liquid stream elgible for vaporization is based primarily on the temperature of the vapor and liquid stream. Typically these streams are chosen such that minimum temperature approach between the condensing and the boiling streams in boiler/condenser 32 or boiler/condenser 38 will be within a range of 0.25° to 3° C. for cryogenic distillation and from 5°-75° C. for elevated temperature distillation.

It should be pointed out that schemes analogous to the one shown in FIG. 1 exist which may look different at first sight. For example, section R1 of the main column, and the associated condenser 16, may be discrete from the actual main distillation column and located above section SS1 of the side column. In this case, sections R2 and R3 will still be part of the main distillation column and heat integration between these sections and the sections SS1 and SS2 of the side column will take place as shown in FIG. 1. However, the liquid feed to the top of R2 will now be withdrawn from the liquid descending section R1 and entering section SS1; and vapor from the top of section R2 will be combined with the vapor ascending section SS1 and entering section R1. Similarly, the bottom section S3 of the main distillation column and the associated reboiler 14 can be moved from the main distillation column to the bottom of the side column and below section SR2. In this case, liquid from the bottom of S2 is combined with the liquid descending SR2 in the side column; and the vapor feed to the bottom of the main column (i.e., S2) is provided by withdrawing a vapor stream ascending Section S3 now located below Section SR2 in the side column.

Other variations of the process described in FIG. 1 can be effected. For example, one variation contemplates a plurality of thermal integrations within the rectification and stripping sections or zones of main distillation column 12 and of side column 22. For example, a plurality of thermal integrations can be achieved by withdrawing a plurality of liquid streams from stripping zones SS1 and SS2 within side column 22 and heat exchanging those streams against multiple vapor streams obtained from rectification zones R2 and R3 of main distillation column 12. Likewise, a plurality of vapor streams may be removed from rectifying sections SR1 and SR2 within side column 22 and heat exchanged against multiple liquid fractions from stripping sections S1 and S2 of main distillation column 12.

Figure 2:
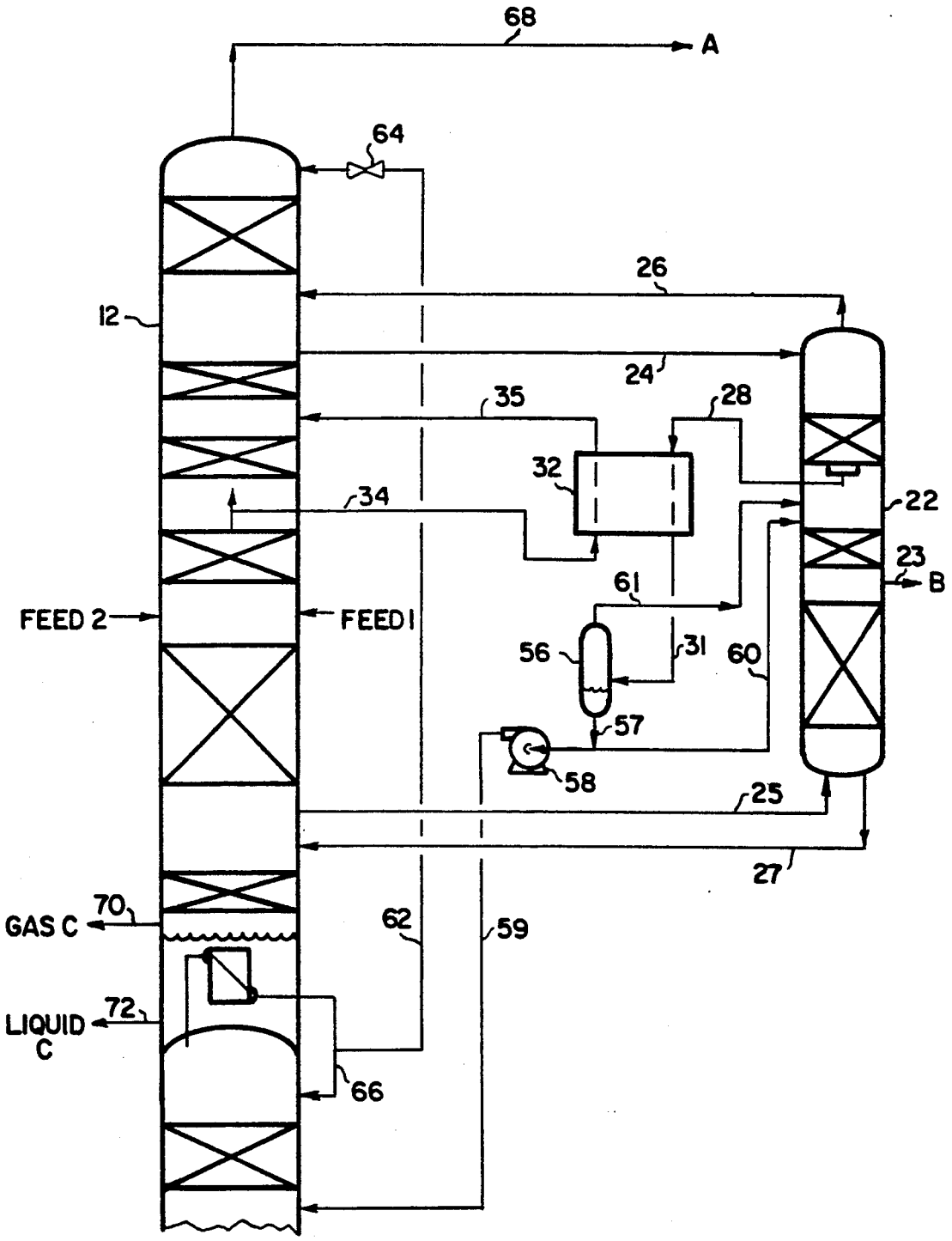
FIG. 2 is a process flow scheme for a distillation system employing heat integration between the rectification section of the low pressure column and stripping section of a side column for the production of argon.

FIG. 2 provides a modification to the single column approach as represented in FIG. 1 in that the main distillation column is comprised of two stages, one operating at high pressure and the other at low pressure as might be experienced in a dual column for the cryogenic distillation of air. Feeds 1 and 2 are introduced to the low pressure side. Thermal integration of the main distillation column 12 with side column 22 is effected with heat exchange between the liquid/vapor streams such that the vapor stream is totally condensed with the resulting condensate then may be directed to other points in the multi-column distillation system.

Referring to FIG. 2, a vapor is removed from the low pressure section of main distillation column 12 and totally condensed in vaporizer/condenser 32. The condensate from vaporizer/condenser 32 is removed via line 35 and returned to an upper portion: i.e., rectification section within the low pressure section of main distillation column 12. Optionally, a portion of the liquid stream in line 35 could also be fed to the rectification section of the high pressure section within main distillation column 12.

Heat exchanging of the vapor is achieved as follows. A liquid fraction is obtained from side column 22 via line 28 and partially vaporized in vaporizer/condenser 32 against the vapor fraction from the main distillation column. The partially vaporized stream then is conveyed via line 31 to phase separator 56 and separated into a vapor fraction and a liquid fraction. The liquid fraction is removed from phase separator 56 via line 57, pressurized via pump 58 and directed via line 59 to an upper portion or rectification section of the high pressure section within main distillation column 12. On the other hand, the balance, or all, of the condensate can be returned to side column 22 via line 60. With the availability of condensate essentially free of heavy components as reflux to the high pressure section of main distillation column 12, a larger portion of the condensed vapor from a boiler/condenser in the lower portion of the low pressure section within main distillation column 12 may be removed via line 62, expanded in JT valve 64 and introduced to an upper portion of the low pressure section within main distillation column 12 for providing reflux thereto. The balance of the condensate can be directed via line 66 to the high pressure section within main distillation column 12. The vapor phase from separator 56 may be removed via line 61 and returned to side column 22.

Other possible variations in the operation of the low pressure section of main distillation column 12 can be practiced. For example, the column may be operated in conventional manner, e.g. a low pressure vapor form of component A may be removed via line 68 while a gaseous form of component C (Gas C) is removed from a lower portion of low pressure section within main distillation column 12 via line 70 and a liquid fraction consisting essentially of component C (Liquid C) is removed via line 72.

To summarize, the processes described in FIGS. 1 and 2 exhibit enhanced efficiency because feeds to the side column are preferentially selected and because of the thermal integration of main distillation column 12 with side column 22. Recovery of component B can be enhanced because the feed rate to side column 22 via lines 24 and 27 can be increased without adversely affecting the performance of the main distillation column. If the vaporization/condensation functions of side column 22 are provided by other process streams or external sources, as in the prior art, there is a limit to the amount of liquid/vapor that can be removed via lines 24 and 27 to side column 22 because of a "pinch" in the rectification and stripping sections. In order to increase the amount of liquid/vapor to side column 22, and thus obtain a higher recovery of B, more boilup and condensation duty are required in main distillation column 12. In contrast, by effecting thermal integration as shown, i.e. wherein a vapor/liquid or both are removed from the main distillation column intermediate the bottom and overhead in main distillation column 12 and heat exchanged against a liquid/vapor from the side column, the selectivity and recovery of preselected component(s) can be achieved in more efficient manner.

The above process design utilizing thermal integration is also enhanced through feed selection to the side column. The feed mechanism involves the selection of a vapor stream from the stripping section of main distillation column 12 as a feed to the side column wherein the vapor stream is of preselected concentration and having lower concentration than that desired in product B of all volatile components and the selection of a liquid stream from an upper portion of main distillation column 12 of preselected concentration having a concentration of component C less than that desired in product B as a feed to the side column. This combination of feeds to side column 22, coupled with thermal integration as described above, greatly enhances the recovery of component B with reduced energy requirements.

Figure 3:
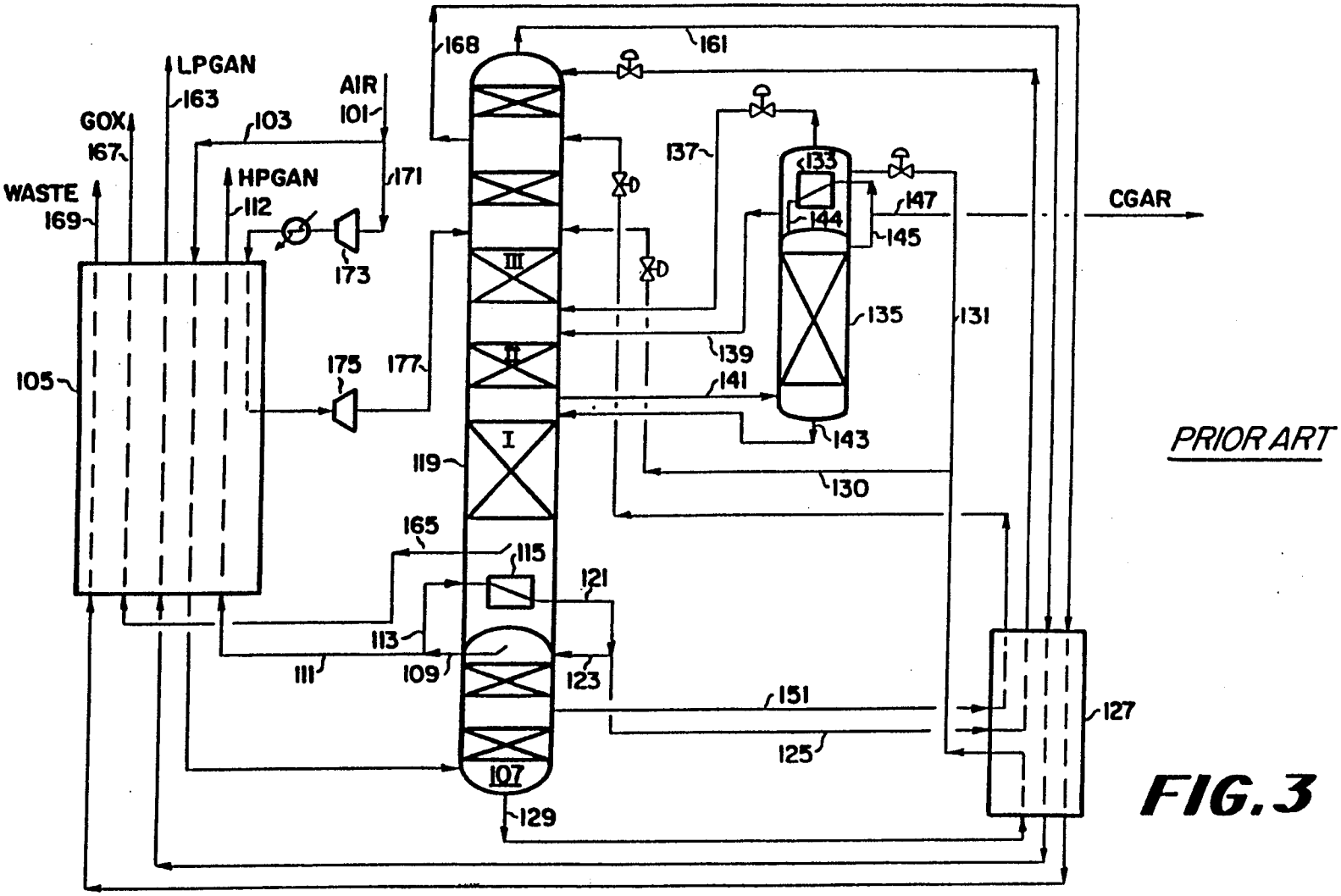
FIG. 3 is a process flow diagram of a prior art method for coupling a side column with a main distillation column to effect recovery of argon in the cryogenic distillation of air.

To better understand the present invention as applied to the separation of air and recovery of argon, it is important to understand the conventional wisdom of the prior art. As an example, a typical prior art process for the cryogenic separation of air to produce nitrogen, oxygen and argon products using a three column system is illustrated in FIG. 3. With reference to FIG. 3, a clean, pressurized air stream is introduced into the process, via line 101. This clean, pressurized air stream is then divided into two portions, lines 103 and 171, respectively. The first portion is cooled in heat changer 105 and fed to high pressure distillation column 107, via line 103, wherein it is rectified into a nitrogen-rich overhead and a crude liquid oxygen bottoms. The nitrogen-rich overhead is removed from high pressure distillation column 107, via line 109, and split into two substreams, lines 111 and 113, respectively. The first substream in line 111 is warmed in heat exchanger 105 and removed from the process as high pressure nitrogen product, via line 112. The second portion, in line 113, is condensed in reboiler/condenser 115, which is located in the bottoms liquid sump of low pressure distillation column 119, and removed from reboiler/condenser 115, via line 121, and further split into two parts. The first part is returned to the top of high pressure distillation column 107, via line 123, to provide reflux: the second part, in line 125, is subcooled in heat exchanger 127, reduced in pressure and fed to top of low pressure distillation column 119 as reflux.

The crude liquid oxygen bottoms from high pressure distillation column 107 is removed, via line 129, subcooled in heat exchanger 127, and split into two sections, lines 130 and 131, respectively. The first section in line 130 is reduced in pressure and fed to an upper intermediate location of low pressure distillation column 119 as crude liquid oxygen reflux for fractionation. The second section in line 131 is reduced in pressure, heat exchanged with crude argon vapor overhead from argon side distillation column 135 wherein it is partially vaporized. The vaporized portion is fed to an intermediate location of low pressure distillation column 119, via line 137 for fractionation. The liquid portion is fed, via line 139, to an intermediate location of low pressure distillation column 119 for fractionation.

An argon-oxygen-containing side stream is removed from a lower-intermediate location of low pressure distillation column 119 and fed, via line 141, to argon side distillation column 135 for rectification into a crude argon overhead stream and a bottoms liquid which is recycled, via line 143, to low pressure distillation column 119. The crude argon overhead stream is removed from argon side distillation column 135, via line 145; has a crude gaseous argon product stream removed, via line 147, and is then fed to boiler/condenser 133, where it is condensed against the second section of the subcooled, high pressure distillation column, crude liquid oxygen bottoms. The condensed crude argon is returned to argon side distillation column 135, via line 144, to provide reflux. Alternatively, crude liquid argon could be removed as a portion of line 144.

The second portion of the feed air, in line 171, is compressed in compressor 173, cooled in heat exchanger 105, expanded in expander 175 to provide refrigeration and fed, via line 177, to low pressure distillation column 119 at an upper-intermediate location. Also as a feed to low pressure distillation column 119, a side stream is removed from an intermediate location of high pressure distillation column 107, via line 151, cooled in heat exchanger 127, reduced in pressure and fed to an upper location of low pressure distillation column 119 as added reflux.

To complete the cycle, a low pressure nitrogen-rich overhead is removed, via line 161, from the top of low pressure distillation column 119, warmed to recover refrigeration in heat exchangers 127 and 105, and removed from the process as low pressure nitrogen product, via line 163. An oxygen-enriched vapor stream is removed, via line 165, from the vapor space in low pressure distillation column 119 above reboiler/condenser 115, warmed in heat exchanger 105 to recover refrigeration and removed, via line 167, from the process as gaseous oxygen product. Finally, an upper vapor stream is removed from low pressure distillation column 119, via line 168, warmed to recover refrigeration in heat exchangers 127 and 105 and then vented from the process as waste, via line 169.

Figure 4:
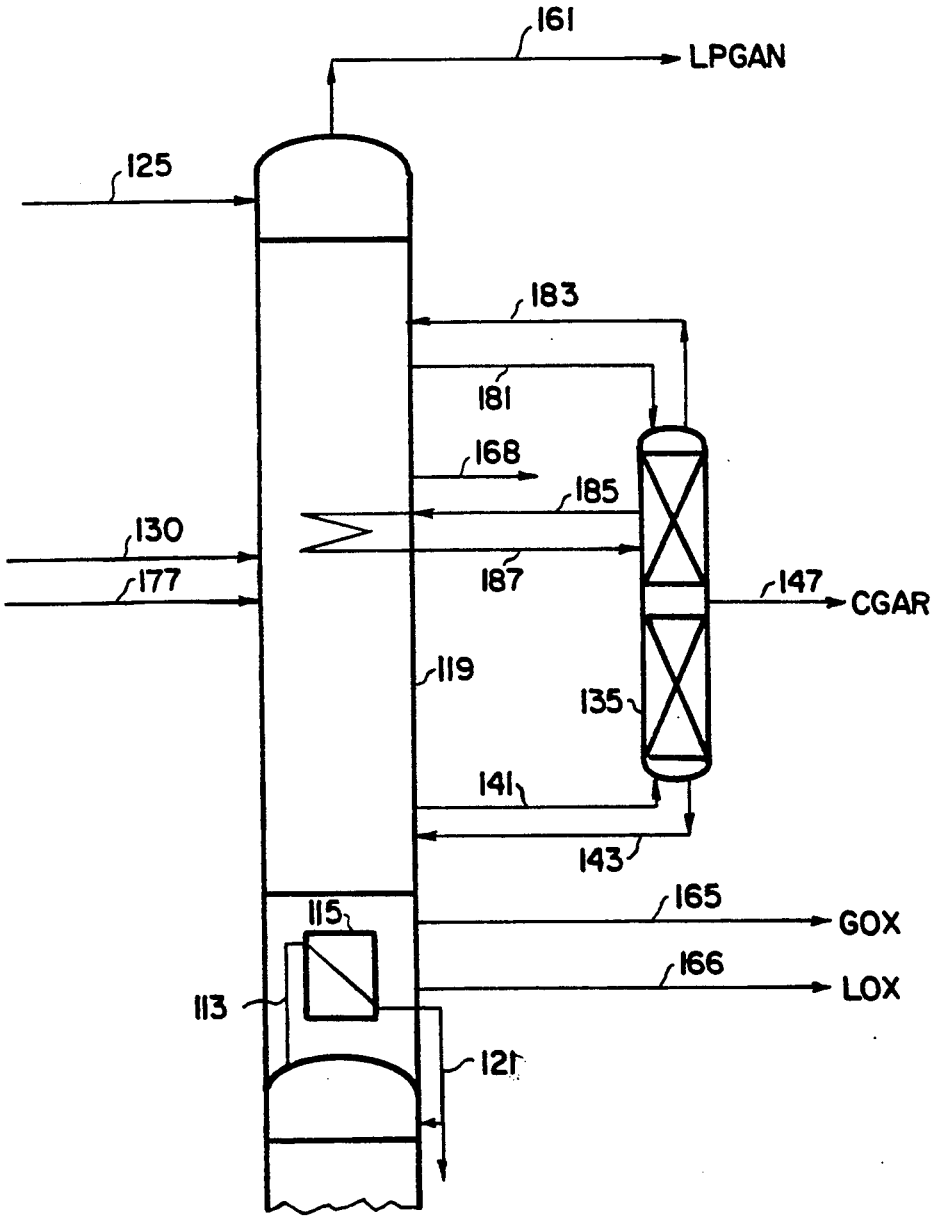
FIG. 4 is a process flow scheme for an air separation scheme employing a combination of a high and low pressure column as the main distillation column system in the distillation system and thermally integrating the stripping section of a side column with the low pressure column for the production of argon.

FIG. 4 illustrates a variation of the embodiment shown in FIG. 3. It differs primarily in that a combination of selective feed and thermal integration is employed to effect argon separation. Numerals in FIG. 4 used for equipment and process lines where similar are identical to those in FIG. 3. Process and equipment differences from those in FIG. 3 are noted through the use of additional numbers in the 180+ series.

In contrast to the argon recovery described in FIG. 3, the embodiment shown in FIG. 4 incorporates an additional feed source in an upper portion or stripping section of the argon side column 135 wherein a liquid fraction substantially free of oxygen is removed via line 181 and introduced to a rectification section of argon side column 135. A gaseous stream containing nitrogen is removed as an overhead via line 183 and directed to low pressure column 119. Utilizing this feed system of both liquid and vapor to argon side column 135, a crude argon product is removed via line 147 intermediate the bottom and overhead of argon side column 135 rather than as a top portion of side column 135 as noted in FIG. 3.

Thermal integration of the argon side column with the low pressure column 119 is achieved by withdrawing a liquid fraction via line 185 from argon side column 135 and at least partially vaporizing the liquid fraction against a vapor fraction in a boiler/condenser located within low pressure column 119. The partially vaporized liquid fraction then is returned to argon side column 135 via line 187.

Alternatively, thermal integration of argon side column 135 can be achieved by thermally integrating the enriching section of argon side column rather than thermally integrating the stripping section as shown in FIG. 4. To achieve thermal integration of the enriching section with the low pressure column 119, a vapor stream is removed from the enriching section or rectification of the argon side column and heat exchanged against liquid in a boiler/condenser located within or outside low pressure column 119. The partially condensed vapor fraction from the enriching section of argon side column 135 then is returned to argon side column. In other words, the difference between this embodiment and the embodiment specifically disclosed in FIG. 4 is the thermal integration of the argon side column in the enriching section as opposed to the thermal integration of the stripping section as shown in FIG. 4. Alternatively, the thermal integration process described in FIG. 1 can also be utilized in the FIG. 4 embodiment wherein thermal integration is achieved in separate vaporizer/condensers for both the stripping section and the enriching sections of argon side column 135. Thermal integration, to the degree shown in FIG. 1, is simply a matter of choice for the operator.

In all of the embodiments described in the Figures, the temperature of the vapor/liquid streams are selected such that the minimum temperature approach between the condensing and the boiling streams in the vaporizer/condensers typically is at least 0.25° to 3° C. in the cryogenic separation of air and from 5°–75° C. in other cases. Liquid from an intermediate location of the side columns is vaporized in the boiler/condensers and generally returned to the side column. The return point is generally at the same location as the liquid removal point. It is possible to decrease the flowrate of liquid such that the liquid stream is totally vaporized in the boiler/condenser. In such a case, the vaporized stream is then returned to the side column at a location which is a couple of theoretical stages of separation below the removal point for liquid. By employing an intermediate boilup in the side column, one can increase the feed rate to the side column which will increase recovery of component B.

The process schemes shown in FIGS. 1–4 can also be adapted for the production of an ultra-high purity nitrogen product in addition to producing nitrogen in standard plants. The main distillation column in this system comprises the combination of the low pressure and high pressure column. The low pressure column as is conventional is operated within a pressure ranging from 15 to 85 psia. A nitrogen rich vapor fraction is removed as an overhead from the low pressure column and recovered as product. Gaseous and liquid oxygen is removed from the bottom of low pressure column and warmed against process streams.

Ultra high purity nitrogen is generated as a coproduct in addition to standard nitrogen product in a side column. In generating ultra high purity nitrogen, a liquid stream, which is essentially free of heavy components (C), such as oxygen and argon, is removed from an upper portion of low pressure column. The concentration of volatile contaminants (I) such as hydrogen, helium and neon in this stream is generally less than 10 ppm by volume. This stream is introduced to the side column for effecting stripping and removal of residual volatiles which may he dissolved in the liquid nitrogen stream. In the side column a vapor fraction is generated in an upper part of side column and this fraction is returned to essentially the same location that the liquid fraction was removed from low pressure column. Also, a vapor fraction which is essentially free of lights and rich in nitrogen is removed from the low pressure column and introduced to a lower section of the side column. An ultra-high purity nitrogen product is removed at an intermediate point from the side column. Liquid from the bottom of the side column rich in argon, and oxygen is returned or refluxed to the low pressure column.

It is apparent that other process schemes can be utilized which are variations of those described in FIGS. 1, 2, 3 and 4 without altering their basic concepts. For example, auxiliary boiler/condensers may be used in combination with the thermally linked boiler/condensers associated with the main distillation column and side column described in the various embodiments of the invention. These auxiliary boiler/condensers or reboilers would use other process streams or steam for effecting boilup in the bottom of the side column as described. Auxiliary condensers would use other process streams for effecting condensing duty at the top of the side column as described. The utilization of auxiliary boiler/condensers, however, would be at the discretion of the operator.

What is claimed is:

1. In a process for the separation of a multi-component stream comprising at least one volatile component A and at least one component of heavier volatility C and a component B having a volatility intermediate that of A and C wherein said multi-component stream is introduced to a multi-column distillation system incorporating a side column, said side column effecting separation and recovery of at least one component from said multi-component stream, the improvement for obtaining enhanced recovery of component B, in a stream containing at least components A, B and C in a multi-column distillation system comprising a main distillation column and a side column comprises the steps:

(a) withdrawing a liquid fraction rich in component B contaminated with component A which has a higher volatility than component B and containing a lower concentration of component C which has a lower volatility than component B from said main distillation column and introducing said liquid fraction to a stripping section within said side column;

(b) withdrawing a vapor fraction rich in component B contaminated with component C which has a lower volatility than component B and containing a lower concentration of component A which has a higher volatility than component B from said main distillation column and introducing said vapor fraction to a rectification section within said side column;

(c) removing component B at preselected concentration from said side column at a point intermediate the introduction point of said liquid fraction rich in component B and containing a much lower concentration of component C and the introduction point of said vapor fraction rich in component B and containing a much lower concentration of component A;

(d) removing a vapor fraction rich in component A from a stripping section within said side column and returning said vapor fraction to said main distillation column;

(e) removing a liquid fraction rich in component C from a rectification section within said side column and returning said liquid fraction to said main distillation column; and (f) thermally integrating said side column with said main distillation column by at least one of the following steps designated (i) and (ii):

(i) vaporizing at least a portion of a liquid fraction obtained from said side column against a vapor fraction obtained from said main distillation column and thereby effecting at least partial condensation of said vapor fraction obtained from the main distillation column and at least partial vaporization of said liquid fraction obtained from said column;

returning at least a portion of the condensed vapor fraction obtained from the main distillation column to the multi-column distillation system; and, returning at least a portion of the vaporized liquid fraction from the side column to the multi-column distillation system; and (ii) condensing at least a portion of a vapor fraction obtained from said side column against a liquid fraction obtained from said main distillation column and thereby vaporizing at least a portion of said liquid fraction obtained from the main distillation column and condensing at least a portion of the vapor obtained from the side column, returning at least a portion of the vaporized liquid fraction obtained from the main distillation column to the multi-column distillation system; and, returning at least a portion of the condensed liquid fraction obtained from the side column to the multi-column distillation system.

2. The process of claim 1 wherein said liquid stream removed from said side column in step (f) is removed from a stripping section in said side column.

3. The process of claim 2 wherein said liquid fraction generated by the condensation of said vapor fraction obtained from said main distillation column is returned to a point substantially near that where said vapor fraction is removed from the main distillation column.

4. The process of claim 2 wherein said vapor fraction obtained by the vaporization of said liquid fraction obtained from said side column is returned to a point substantially near the point where the liquid fraction was removed.

5. The process of claim 2 wherein a vapor stream removed from said side column in step (f) is removed from a rectification section within said side column.

6. The process of claim 5 wherein said liquid fraction generated by the condensation of said vapor fraction obtained from said side column is returned to a point substantially near that where said vapor fraction was removed from said side column.

7. The process of claim 5 wherein said vapor fraction obtained by the vaporization of said liquid fraction obtained from said main distillation column is returned to substantially near the same point where the liquid fraction was removed from said main distillation column.

8. The process of claim 5 wherein thermal coupling is effected by vaporizing at least a portion of a liquid stream obtained from a stripping section within the side column against a vapor stream obtained from said a rectification section of said main distillation column.

9. The process of claim 8 wherein said liquid stream obtained from a stripping section is partially vaporized, separated into a vapor fraction and a liquid fraction and each fraction returned to the side column.

10. The process of claim 8 wherein said vapor stream obtained from a rectifying section from said main distillation column is partially condensed, separated into a vapor fraction and a liquid fraction, and each fraction returned to the main distillation column.

11. The process of claim 1 wherein the vapor from the side column and returned to the main distillation column in step (d) is returned to a point substantially near the removal point for said liquid fraction.

12. The process of claim 3 wherein said liquid stream obtained from a stripping section from said main distillation column is partially vaporized, separated into a vapor fraction and a liquid fraction and each fraction returned to the main distillation column.

13. The process of claim 1 wherein said main distillation column is a double column system comprising a high pressure column and a low pressure column and the multi-component feed is air.

14. The process of claim 13 wherein the liquid fraction to said side column consists essentially of nitrogen and is essentially free of components having lower volatility than argon.

15. The process of claim 13 wherein a plurality of thermal integrations between of said main distillation column and said side column are effected, the first thermal integration involving the removal of vapor from a rectifying section within said side column and condensing it against a liquid fraction obtained from a stripping section of the main distillation column.

16. The process of claim 15 wherein at least a second thermal integration wherein a vapor fraction intermediate the introduction of the multi-component stream feed and overhead from the main distillation column is condensed against a liquid fraction obtained from an upper portion of said side column.

17. The process according to claim 13 wherien thermal integration is achieved by step (ii) and at least a portion of the condensed liquid fraction is pressurized and returned to the high pressure column within the multi-column distillation system.

18. The process according to claim 1 wherein the vapor stream in step (f) is totally condensed and is returned to the main distillation column at a location point above the point from where said vapor fraction is taken for effecting condensation thereof and vaporization of said liquid fraction from said side column.

* * * * *